United States Patent [19]

Chao

[11] Patent Number: 4,795,161

[45] Date of Patent: Jan. 3, 1989

[54] CARD GAME

[76] Inventor: Dwight W. Chao, 17220 Newhope St., Ste. 101-102, Fountain Valley, Calif. 92708

[21] Appl. No.: 129,607

[22] Filed: Dec. 7, 1987

[51] Int. Cl.[4] ..... A63F 1/04

[52] U.S. Cl. ..... 273/292; 273/296

[58] Field of Search ..... 273/292, 293, 295, 303, 273/306, 296

[56] References Cited

U.S. PATENT DOCUMENTS

| | | | |
|---|---|---|---|
| D. 59,761 | 11/1921 | McCarthy | 273/292 X |
| 957,105 | 5/1910 | Russell | 273/306 |
| 1,484,564 | 2/1924 | Riffert | 273/292 |
| 1,581,859 | 4/1926 | New | 273/306 |
| 3,618,231 | 11/1971 | Nason | 273/295 |
| 4,591,162 | 5/1986 | Fakhoury | 273/303 |
| 4,741,540 | 5/1988 | Levine | 273/292 |

*Primary Examiner*—Anton O. Oechsle

*Attorney, Agent, or Firm*—Francis X. LoJacono

[57] ABSTRACT

A card game and a method of playing having a deck of cards including a first set with numbers printed thereon in a consecutive manner, the numbers being arranged to match the numbers of a corresponding game of chance, and a second set of cards with indicia printed thereon providing space for favorite numbers to be inserted by the player. The deck of cards are shuffled and a number of cards are dealt that would match the official randomly selected numbers or symbols of the corresponding game of chance.

12 Claims, 1 Drawing Sheet

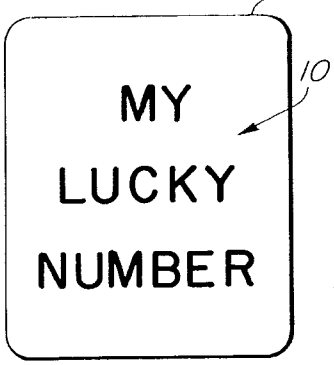
FIG. 1
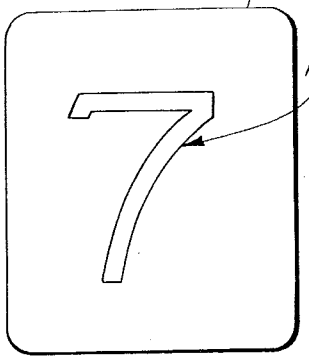
FIG. 2
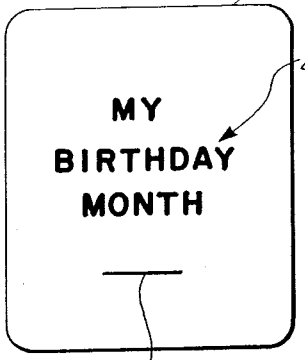
FIG. 3
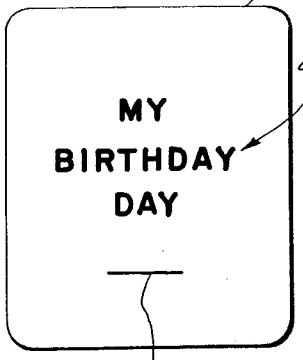
FIG. 4
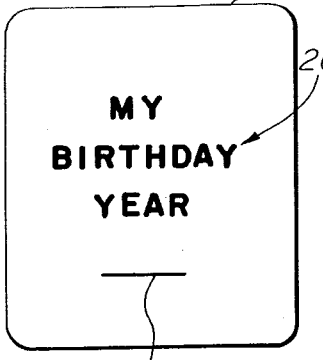
FIG. 5
FIG. 6
FIG. 7
FIG. 8
FIG. 9
FIG. 10

CARD GAME

BACKGROUND OF THE INVENTION

1. Field of the Invention

This invention relates generally to a card game and more particularly to a card game that aids the player in choosing selective cards from one or two groups, wherein one group has numerical or other symbols printed thereon, and the second group has blank spaces to be filled in by the player to establish a "My Lucky Number" deck of cards, so as to provide an amusement game which is based on probabilities and each player's mental suggestive powers to pick out his or her own numbers or symbols.

2. Description of the Prior Art

Since the establishment of Lotto games in several States to award large sums of money as prizes, many participants of such games have problems in selecting groups of preferred numbers.

This problem is also prevalent when individuals play many similar games of chance, whether it be the selection of one number or several numbers that are required to win a given type of game, such as selecting a number or numbers for betting on horses, as well as playing Lotto, Keno and other games requiring symbol matching. Moreover, the majority of individuals participating in games of chance have several favorite numbers, and often these numbers outweight the amount of numbers allowed to be picked with respect to a particular game.

Therefore, the present invention as hereinafter described will allow individuals to select their special numbers or symbols with the aid of mental suggestive powers.

Many card games of the prior art are generally complete games in themselves. That is, these game devices include cards and game boards which are employed to play with other players or partners. As an example of such games one can look to the fortune-telling game as disclosed in U.S. Pat. No. 3,970,315 which includes an astrology board defining a plurality of zodiac stations containing horoscopic intelligence including indexing tokens bearing interrelated data and postionable over the zodiac stations.

In U.S. Pat. No. 1,314,522 there is disclosed another card game having two sets of an equal number of cards, one set differing from the other in that one has uneven numbers, together with questions and answers appropriate for male members or players, the other set having even numbers with questions and answers appropriate for female players of the game.

U.S. Pat. No. 4,462,597 to Caramaza discloses a combination tombola and lottery card game having cards numbered 1 to 90 characterized by images of oneiric or traditional import, derived from the popular Italian games of lottery and tombola combined.

Another fortune-telling game and deck of cards is disclosed in U.S. Pat. No. 4,583,737 to Falcone et al which comprises the use of a deck of fortune-telling cards for indicating a response to a query. Also refer to U.S. Pat. No. 4,014,551.

SUMMARY OF THE INVENTION

It is an important object of the present invention to provide a card game that enables the player to select a group of numbers or symbols with the assistance of his or her own mental suggestive powers in attempting to predict a lucky number or numbers, and symbol or symbols.

A further object of the present invention is to provide a card game of this character that is an amusement game which is based on probabilities combined with one's mental suggestive powers to choose numbers or symbols.

A still further object of the invention is to provide a card game of this type wherein individuals using the cards can create their own systems of selecting cards so as to establish sets of numbers for specific games of chance.

Yet another object of the present invention is to provide a card game that simplifies a player's selection of a single or a group of numbers to play a specific game of chance requiring one or more numbers or, in some cases, symbols.

Still another object of the invention is to provide a game of this character that allows the player to adopt the present game to aid in the playing of a second game such as a state-operated Lotto game, Keno, Wheels of Fortune or some other game of chance that employs numbers or symbols.

Another object of the present invention is to provide a card game having a deck of cards which includes at least two sets of cards, one set having numbers printed thereon from one of any number of consecutive numbers of cards. The second set of cards has fill-in blank areas to allow the player to insert special numbers of his selection such as the day, month or year of a particular birth, anniversary, or any other favorite number of the player's choice.

The various features of novelty which characterize the invention are pointed out with particularly in the claims annexed to and forming a part of this disclosure. For a better understanding of the invention, its operating advantages by its use, reference should be had to the accompanying drawings and descriptive matter in which there is illustrated and described the preferred embodiments of the invention.

BRIEF DESCRIPTION OF THE DRAWINGS

Referring more particularly to the accompanying drawings, which are for illustrative purposes only:

FIG. 1 is a view of the back of a typical playing card having indicia printed thereon;

FIG. 2 is a view of the face side of a typical playing card with a number printed thereon;

FIG. 3 is a view of the face side of what is referred to as a blank card having a blank space for inserting the month of the player's birth;

FIG. 4 illustrates a card for the player's day of birth;

FIG. 5 illustrates a card for the year of birth;

FIG. 6 illustrates a card for one to insert his or her favorite number;

FIG. 7 illustrates an example of a playing card that has a symbol printed thereon;

FIGS. 8, 9 and 10 each indicate specific sets of cards with the printing on the back thereon corresponding to a particular game of chance.

DESCRIPTION OF THE PREFERRED EMBODIMENT

Referring more particularly to the drawings, there are illustrated playing cards to be selectively arranged in a group defining a deck of cards.

As will be further defined herein, a group of cards can be selected to form a set from which a player randomly deals a number or numbers to correspond to a particular game of chance such as, for example, Keno, Lotto 5/40, Lotto 6/49 or "pick sixes" in horse races.

As an example of how one might use a deck of cards for a particular game, one can use Lotto 6/49, a game of chance now being operated by the State of California. A group of cards of the type shown in FIGS. 1 and 2 are selected. That is, indicia 10 is printed on the back of card 12 represented by the printing of "My Lucky Number". The opposite side, otherwise referred to as the face side, is preprinted with a number such as indicated at 14.

Accordingly, when the player wishes to play the present game to aid in the selection of six numbers as required in the playing of Lotto 6/49, cards 1 through 49 are grouped together in a set. If, as another example, the cards are to be used to correspond to Lotto 5/40, then only forty consecutive cards, 1 through 40, are arranged in a set to define a Lotto 5/40 deck.

After the specific group of cards are together as a deck, the player will shuffle the deck several times. Preferably, at this time the player closes his or her eyes and concentrates on the game that is being played, and mentally asks for his or her lucky number repeatedly so as to aid the inner sense to pick out the cards. Thus, if one is trying to pick numbers for playing Lotto 6/49, six cards are chosen. The method of selecting the shuffled cards may vary from one player to another. That is, the cards can be dealt in consecutive order or in a random order, or one may wish to spread the shuffled cards out and randomly pick six numbers while concentrating as mentioned herein. Another method of selecting cards would be to shuffle the deck of cards and deal one card at a time. Thus, one shuffles the deck before dealing and does not replace the picked cards until the proper number of cards are selected.

To add to the above method of playing 'My Lucky Number', a second set of cards may be employed to form a complete deck. The second set comprises cards 16, 18, 20 and 22, as illustrated in FIGS. 3, 4, 5 and 6, respectively. These cards will hereinafter be referred to as blank cards since each card is provided with a blank spot 24 whereby the particular player inserts his or her special number to correspond to the printed matter 26 on the face of each card. As illustrated, card 16 reads "My Birthday Month", Hence, the player inserts his or her month of birth. For example, if one was born in October the number inserted in blank 24 would be 10. Card 18 has a blank for one's day of birth; card 20 for one's year of birth; and card 22 for inserting one's favorite number. Additional blank cards can be employed to insert numbers for one's anniversary day, month and year, and so on.

Thus, two sets of cards are intermingled to form a single deck of cards.

There are other games of chance that use symbol cards, or Chinese characters, and as an example thereof, FIG. 7 illustrates card 30 as having a symbol 32 printed on the face thereof.

FIGS. 8, 9 and 10 are each illustrated having reference to a specific game of chance printed on the back thereof. Cards 34 would be a deck cards printed specifically for Lotto 6/49, and thus the deck would have only cards marked from 1 through 49 and several blank cards as indicated in cards 16, 18, 20 and 26. The same is true for cards 36 marked Keno. This deck would have a set of cards marked 1 through 80 plus several blank cards. Cards 38 would be a complete deck of cards that would correspond to the game Wheel of Fortune.

The foregoing is a description of preferred embodiments of the invention which are given here by way of example only. The invention is not to be taken as limited to any of the specific features as described, but comprehends all such variations thereof as come within the scope of the appended claims.

I claim:

1. A card game to aid in the selection of numbers to correspond to a particular game of chance, comprising:

a deck of cards having indicia printed on the back of each card;

a number printed on the face of each card wherein the numbers printed thereon run in consecutive order to correspond to the numbers used in the associated game of chance to allow the player of said card game to randomly select one or more cards from said deck of cards, hoping that the selection thereof matches the winning numbers of said game of chance; and wherein said deck of cards includes:

a first set of cards having said numbers printed thereon; and a second set of cards defining blank cards on each of which the player thereof inserts a favorite number.

2. A card game as recited in claim 1, wherein each blank of said second set of cards has indicia printed thereon for indicating the year or the month or the day of birth and/or other special dates of the player's selection, wherein each number thereof is inserted in a blank spot on the respective card.

3. A card game as recited in claim 2, wherein the corresponding game of chance is Lotto 6/49, said first set of cards being numbered consecutively from 1 through 49.

4. A card game as recited in claim 2, wherein the corresponding game of chance is Lotto 5/40, said first set of cards being numbered consecutively from 1 through 40.

5. A card game as recited in claim 2, wherein the corresponding game of chance is Keno, said first set of cards being numbered consecutively from 1 through 80.

6. A card game as recited in claim 2, wherein the corresponding game of chance is horse racing, said first set of cards being the numbers of horses participating in a race or races.

7. A method of forming a deck of playing cards to aid in the selection of numbers to correspond to matching numbers of a given game of chance, comprising the steps of:

forming a deck of cards having indicia printed thereon;

printing numbers on the faces of said cards in consecutive order; and using numbers that correspond to the numbers used in the corresponding game of chance;

wherein the deck is formed including the step of forming said deck of cards having a first set of cards printed with said numbers thereon and a second set of cards having blank spaces whereby the player inserts his or her own particular favorite numbers.

8. A method of playing a card game to aid in the selection of numbers to correspond to matching numbers of chance, comprising the steps of:

forming a deck of cards which comprises a first and a second set of said cards, said cards of said first set being printed with consecutive numbers thereon corresponding to the numbers used in the corresponding game of chance, and said cards of said second set being printed with indicia thereon indicating the place for insertion of special numbers by the player of said card game;

inserting special numbers on said cards of said second set;

inter-shuffling said second set of cards with said first set of cards to thoroughly mix all of said cards;

using mental power to concentrate on a favorite number or numbers while shuffling said cards, said mental power including closing one's eyes for concentration and praying; and picking out one or more cards to be used to provide a number or numbers matching the number or numbers of the corresponding game of chance.

9. A method of playing a card game as recited in claim 8, wherein said numbered cards are marked 1 through 40.

10. A method of playing a card game as recited in claim 8, wherein said numbered cards are marked 1 through 49.

11. A method of playing a card game as recited in claim 8, wherein said numbered cards are marked 1 through 80.

12. A method of playing a card game as recited in claim 8, wherein said numbered cards include all horse numbers in a race or races.

* * * * *